United States Patent [19]

Solitt et al.

[11] 4,371,077

[45] Feb. 1, 1983

[54] JEWELRY DISPLAY DEVICE

[76] Inventors: Samuel G. Solitt, 2121 Brookshire Rd.; Jerry Shaw, 50 W. Fairlawn Rd., both of Akron, Ohio 44313

[21] Appl. No.: 256,986

[22] Filed: Apr. 24, 1981

[51] Int. Cl.[3] ..... B65D 81/36; A47F 7/03; A47G 1/16; B65D 73/00

[52] U.S. Cl. ..... 206/45.14; 206/458; 206/566; 248/472; 248/487

[58] Field of Search ..... 206/45.14, 45.15, 45.16, 206/45.18, 457, 458, 566; 217/9; 434/399, 400; 248/461, 487, 472; D28/65

[56] References Cited

U.S. PATENT DOCUMENTS

| | | | |
|---|---|---|---|
| 929,980 | 8/1909 | Popper | 434/399 |
| 1,359,617 | 11/1920 | Nielsen | 248/450 |
| 1,641,861 | 9/1927 | Moss | 206/45.18 |
| 1,711,348 | 4/1929 | Hirsch | 206/288 |
| 1,713,584 | 5/1929 | Wolf | 206/294 |
| 2,368,959 | 2/1945 | Winslow | 248/487 |
| 2,389,788 | 11/1945 | Lathrop | 132/79 |
| 3,858,718 | 1/1975 | Roy | 206/45.19 |
| 3,930,702 | 1/1976 | Pichowicz | 312/245 |
| 4,119,107 | 10/1978 | Pinzone et al. | 132/79 G |
| 4,153,154 | 5/1979 | Ruscher | 206/45.19 |

*Primary Examiner*—William Price
*Assistant Examiner*—Brenda J. Ehrhardt
*Attorney, Agent, or Firm*—Reese Taylor

[57] ABSTRACT

A jewelry display device includes a frame, a support for the frame and a plate pivotally carried on the frame for movement about an essentially horizontal axis. The plate carries, on one side thereof, an outline shape simulating at least the head and a part of the upper body of a human being and on the reverse side carries a reflective surface or mirror. The outline shape is capable of having pieces of jewelry displayed in a realistic environment so as to assist a potential purchaser in evaluating the desirability of the jewelry. A modified form of the invention includes a display pad to which the basic display unit just described is pivotally attached so that the display unit per se can be moved from a stored position to an elevated display position. In this form of the invention, the frame support is pivotally mounted to the supporting base or display pad and the frame is then pivotally mounted itself so that it can swing out for display purposes. A further modified form of the invention includes a carrying case into which the display unit is incorporated. The frame itself is again pivotally mounted on a frame support for pivoting about a vertical axis and the frame support is pivotally mounted to the carrying case one half of which serves as the supporting base and display pad so that the entire assembly can be collapsed for carrying purposes and elevated for display purposes.

17 Claims, 8 Drawing Figures

JEWELRY DISPLAY DEVICE

BACKGROUND OF THE INVENTION

This invention relates in general to means for transporting and/or displaying jewelry and relates in particular to a device intended to enhance the display of jewelry by presenting it in a realistic fashion to a potential purchaser.

DESCRIPTION OF THE PRIOR ART

Jewelry is commonly displayed and presented to purchasers in a variety of means, ranging from simple display on a counter to actually physically placing the jewelry on the potential purchaser and viewing the same in a mirror. The present invention is intended to combine the best features of all of these methods.

With regard to patent prior art, there are a number of patents generally related to the display of jewelry and, for that matter, other merchandise, which are generally relevant.

For example, Moss U.S. Pat. No. 1,641,861 discloses a display box wherein the sections are hinged and one section can be used as a display surface for the merchandise.

Lathrop U.S. Pat. No. 2,389,798 discloses a traveling case which can be opened so that one side is arranged to lie in a flat condition. A pair of panels are hinged by an intermediate portion and can be opened to lie flat on a supporting surface.

Ruscher U.S. Pat. No. 4,153,154 shows a generally rectangular shaped small portable display case which provides a clear or transparent viewing area so that the items can be displayed to advantage without sacrificing security.

Pichowicz U.S. Pat. No. 3,930,702 discloses a decorative wall jewelry cabinet having a decorative member on one side of a door and a mirror on the reverse side thereof.

Roy U.S. Pat. No. 3,858,718 discloses a jewelry display box having an article receiving pad secured thereto and shaped to form a raised pedistal for viewing and display.

Pinzone U.S. Pat. No. 4,119,107 discloses a vanity case with a telescoping mirror. A support is received within a box and an L-shaped structure is secured to the support and includes a vertical arm and a horizontal arm, with the arm being pivoted to the support. The arms can be telescoped and collapsed so that they can be carried within the box and a pivoting mirror is also carried on the outboard of the arm.

Hirsch U.S. Pat. No. 1,711,348 discloses a pop-up figure intended to facilitate the display of wearing apparel. This device has the approximate configuration of part of a human torso and head and slits which correspond to the shoulders of the individual so that the garmet can be draped over the outline for display purposes.

Wolf U.S. Pat. No. 1,713,584 discloses a display form with an illustration of the bust of an individual. Pockets are slit for displaying a handkerchief and cut outs in the neck are provided so that a tie can be displayed.

Nielsen U.S. Pat. No. 1,359,617 discloses a display card which has the representation of an individual on one surface and includes slots and V-shaped slots suitable for inserting a tie or handkerchief so that the prospective purchaser can be given some concept of the eventual appearance of the article.

This prior art, in general, discloses a variety of jewelry boxes and also discloses the utilization of collapsible members which can be stored for transportation purposes within a carrying case and then expanded when the case is opened so that they can be utilized for the purpose for which they are intended. Finally, this art generally shows the utilization of outline-shaped figures which are capable of assisting in the display of wearing apparel or accessories so as to present a more realistic view to the prospective purchaser.

SUMMARY OF THE INVENTION

It has been discovered, however, that particularly with regard to jewelry, a greatly enhanced and realistic display can be achieved by providing, in one version of the invention, a carrying case which has a mating, hinged base and top and which is capable of being closed so as to store and carry the jewelry for transportation.

It has been discovered that this carrying case can be equipped with a frame support pivotally attached to the base of the carrying case and with a frame also pivotally attached to the frame support. The frame itself carries a plate which pivots about a horizontal axis and this plate has, on one side, an outline shape of a human head and on the other side a mirror. The frame support pivots along a horizontal axis while the frame itself pivots about a vertical axis and the plate pivots about a horizontal axis. In this way, it has been found that the overall assembly can be folded down into the base of the carrying case for storage or transportation and can be brought to an extended position and swung out for jewelry display purposes.

It has also been discovered that the invention can be modified so that the lid of the carrying case can be eliminated if desired and the device can be employed simply with the base and the display unit.

Finally, it has been discovered that the invention can be simplified still further be eliminating the base entirely and employing a free standing unit which consists of a frame and the swingable and pivotable mirror/outline shape combination.

Production of an improved jewelry display unit of the character above described accordingly becomes the principal object of this invention, with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Figure 1:
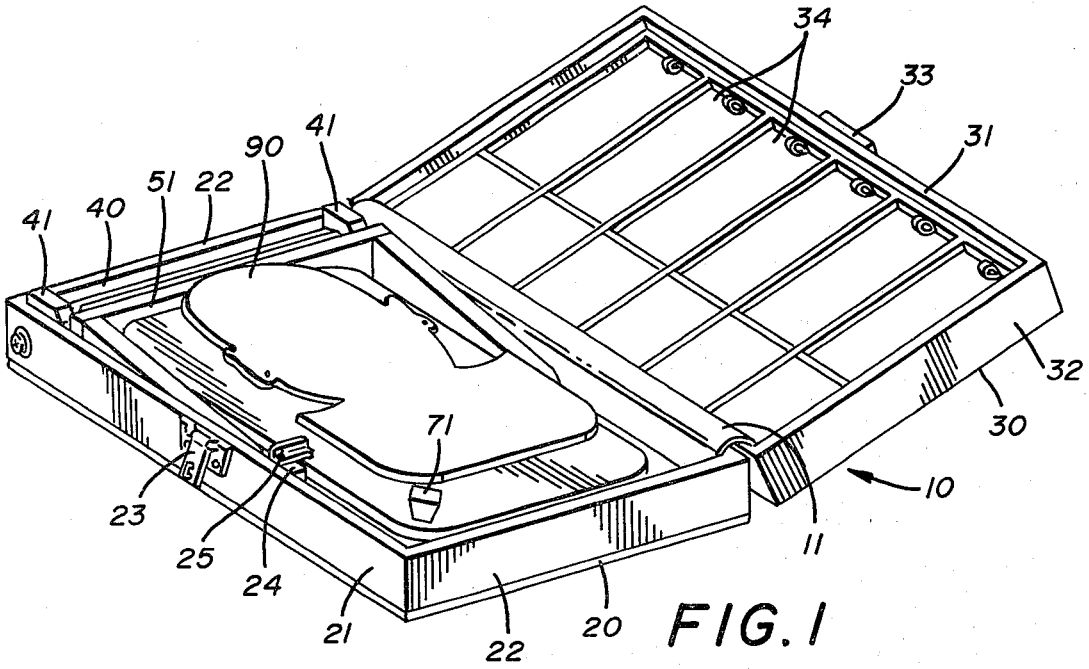
FIG. 1 is a perspective view of one form of the invention, showing the carrying case in an open position and the display unit in a collapsed condition.

Referring first to FIGS. 1 through 6, for a description of one form of the invention, it will be noted that the improved jewelry display device, generally indicated by the numeral 10, includes a carrying case which is essentially comprised of a base 20 and a cover or lid 30 hinged together as indicated by the numeral 11.

The base 20 includes upstanding opposed sidewalls 21,21 and opposed end walls 22,22, while the cover 30 includes opposed sidewalls 31,31 and opposed end walls 32,32. It should be understood that the exposed surfaces of base 20 will be lined with suitable material such as is commonly used in displaying jewelry.

A conventional latching arrangement generally indicated by the numerals 23 and 33 is provided so that the cover 30 may be closed on the base 20 and the two secured together so that the entire device can be carried without inadvertent opening. The latch arrangement 23,33 is illustrative only. Thus, an elongate flap could be secured to one sidewall 21 and mating Velcro® strips could be placed on the flap and one sidewall 31.

The cover 30 also includes a plurality of pockets or storage areas 34,34 which, if desired, can be utilized to carry the jewelry which ultimately is to be displayed. These, however, are optional and the cover or lid 30 could simply be lined with felt or some similar material.

Still referring to FIGS. 1 through 6 of the drawings, particular attention is directed to the actual display unit itself which is carried by the base 20.

This display unit includes a number of components. First, there is an elongate frame support 40 which is carried by the base 20 adjacent one end wall 22 and which is pivotally mounted therein. Support blocks 41,41 are provided at opposed sides of the base 20 and elongate pivot rods 42,42 are secured to the base 20 between the sidewalls 21,21 and engaging the blocks 41,41 to the frame support 40 so that the support 40 can pivot about a horizontal axis.

Secured to the frame support 40 is the frame itself which is generally indicated by the numeral 50. This frame is essentially U-shaped and includes a base 51 and opposed projecting legs 52,52. A pivot rod 53 is journaled between the legs 52,52 at their outboard ends for purposes which will be described.

The frame 50 is pivotally secured to the base 41 in a detent type arrangement generally indicated by the numeral 60. This permits the frame 50 to pivot about a vertical axis so as to swing from the position shown, for example, in FIG. 2 of the drawings to the position shown in FIG. 3. It should be understood that the detent mechanism 60 permits, in the preferred embodiment of the invention, three alternative positions although, of course, the precise number is a matter of choice.

Secured to the frame 50 between the legs 52,52 is a plate 70. This plate is journaled on the rod 54 so that it can pivot about the axis of that rod, or in other words, about a horizontal axis.

On one side of the plate 70, a mirror surface 80 is provided and on the other side an outline shape 90 is provided. The outline shape at least takes the configuration of a human head and preferably part of the upper body as well so as to facilitate display of the jewelry as will be described. Furthermore, this outline shape can be constructed in bas relief or embossed for even more realistic three dimensional effect. The outline shape is illustrated in a full space posture although it may be modified so that the head is rotated somewhat.

It should be noted also at this point that the outline shape 90 is mounted by means of a mounting block 72 on the plate 70 so that it is spaced from the face of the plate to permit ready access to the outline shape to affix or remove the jewelry being displayed.

Also mounted on the ear-lobe area 91 of the outline shape 90 are support or attachment means 92. A perforation or hole 93 is also provided in this area to facilitate attachment and removal of earrings E for display purposes.

Figure 2:
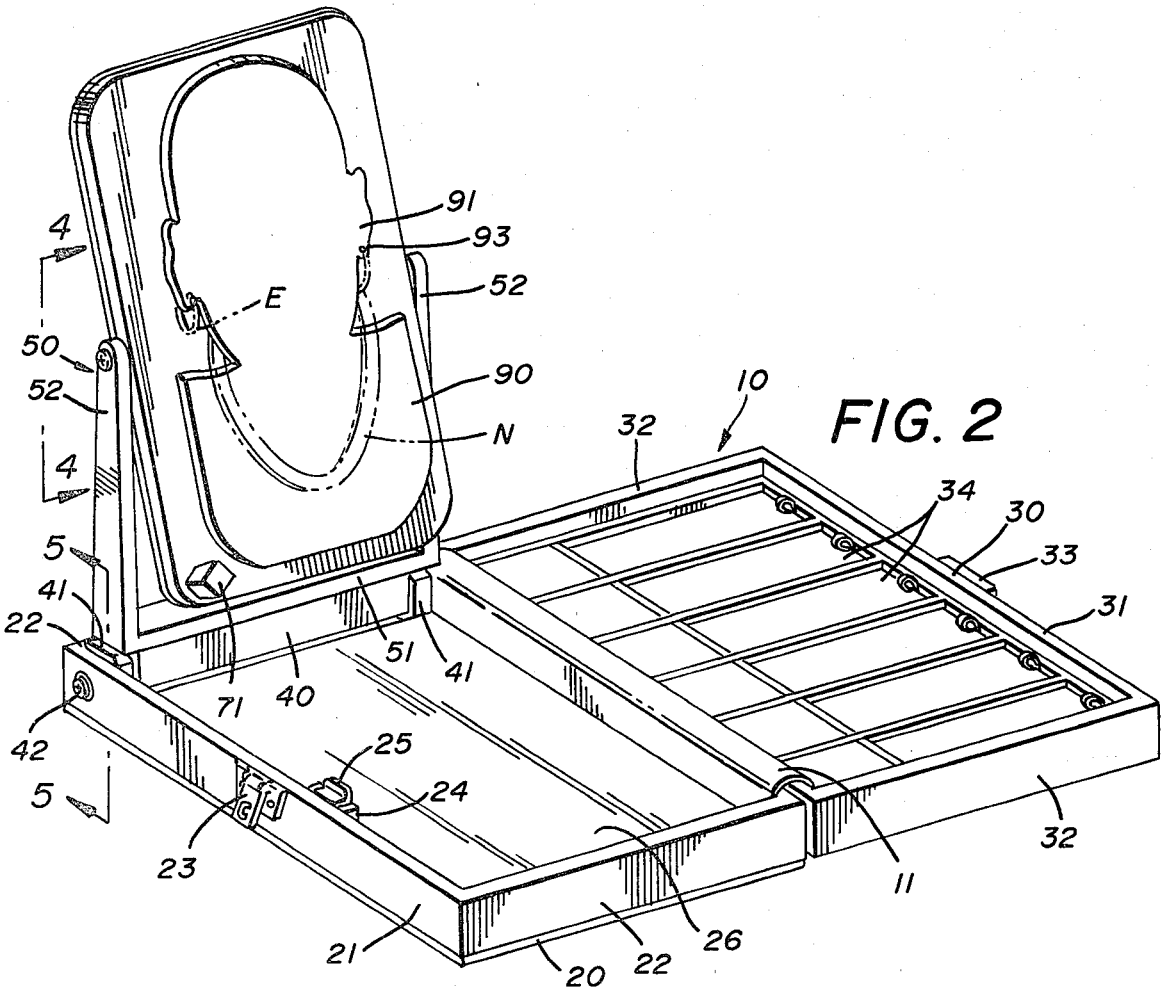
FIG. 2 is a view similar to FIG. 1, showing the display unit in an elevated condition.
Figure 3:
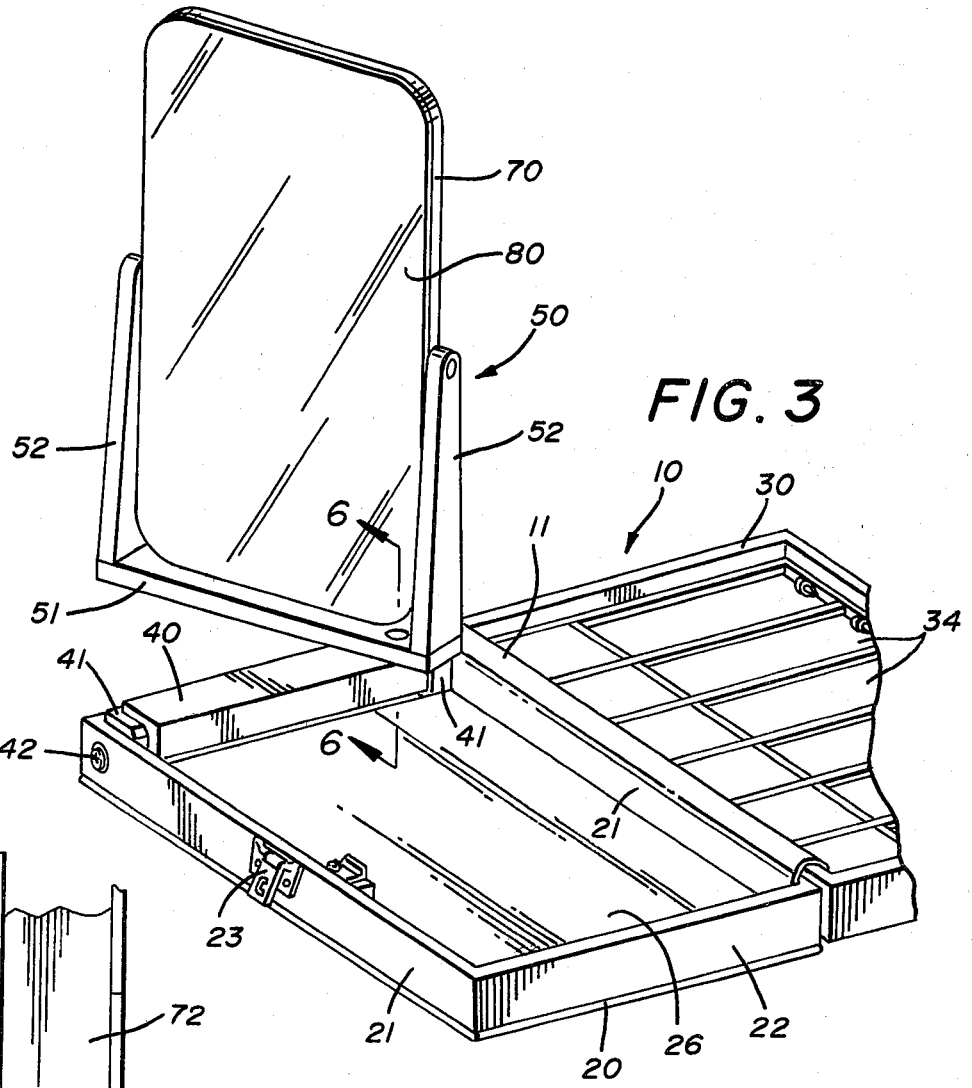
FIG. 3 is a view similar to FIG. 2, showing the display unit in an elevated and extended position.

Also carried on one face of the plate 70 is a handle 71, which facilitates lifting of the display unit from the collapsed position of FIG. 1 to the elevated position of FIG. 2.

Finally, the base 20 carries a support block 24 and a pivoting latch 25 which is employed to retain the overall display unit in the collapsed position of FIG. 1 when the case 10 is being used for transportation or storage purposes. This prevents inadvertent damage to the display unit.

It should be noted here that one simple pivoting type latch arrangement has been illustrated, but it is believed that other could be devised so long as they are relatively easy to release but capable of securely holding the display unit in place.

In use the device will first be opened to the condition of FIGS. 1 and 2 and the display unit elevated. In this position the bottom of base 20, which is lined with suitable soft material 26 will serve as a conventional show pad although integral with the overall carrying case. At that time, the prospective purchaser can select the jewelry such as either the earrings E or the necklace N from the supply pockets 34 or, if desired, some other display areas in the store. It is then possible to affix the earrings E or the necklace N or both to the outline shape 90 so that the prospective purchaser can obtain a realistic impression of the appearance of the jewelry on an actual person. The earrings can be attached to the lobe portion 91 and the necklace can be draped about support block 72 and about the neck (see FIG. 2).

If desired, in addition to this or alternatively to it, the prospective purchaser can herself attach the jewelry to her own head and the plate 70 is simply pivoted about the horizontal axis so that the mirror or reflective surface 80 is employed.

Figure 7:
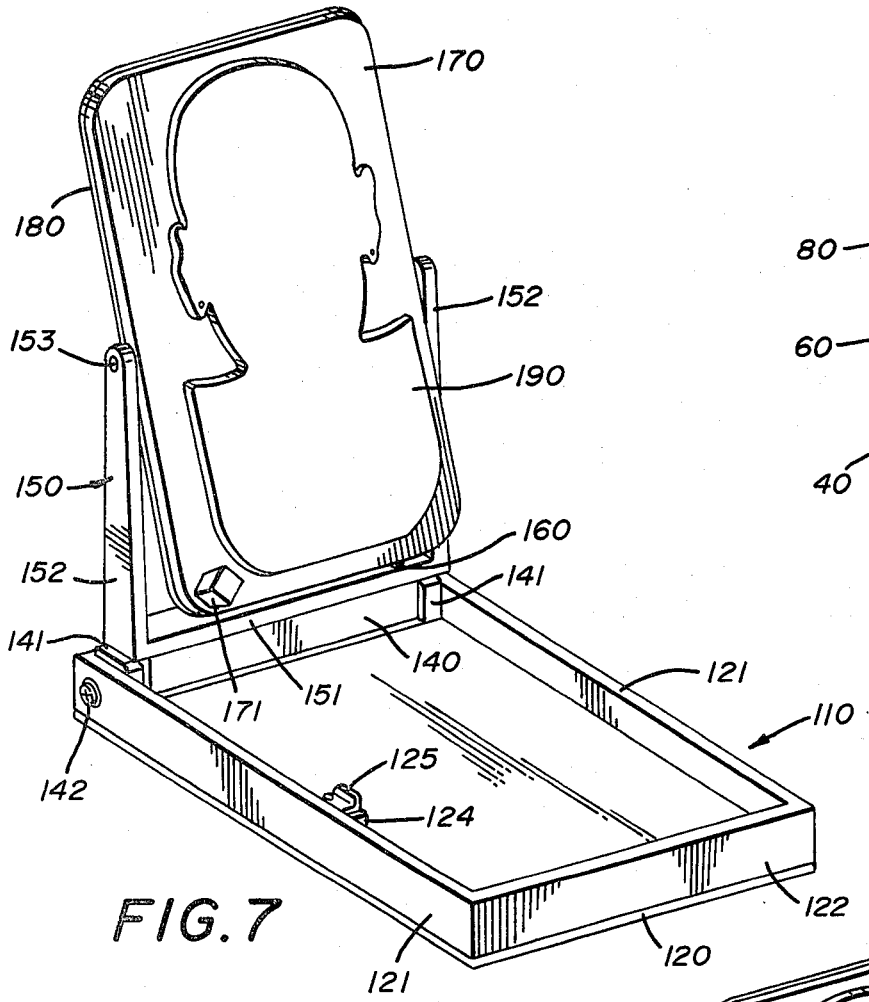
FIG. 7 is a perspective view of a first modified form of the invention.
Figure 6:
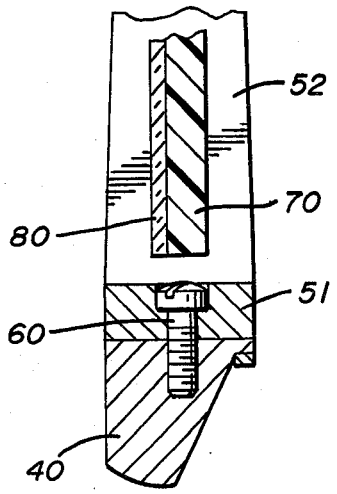
FIG. 6 is a sectional view taken along the line 6—6 of FIG. 3.

FIG. 7 discloses a further embodiment of the present invention which is essentially structurally the same as that shown in FIGS. 1 through 6 except that the device is not intended to be used to transport jewelry, but is simply intended to be used as a counter display unit.

Similar numbers with a prefix in the 100 series will be utilized to denote similar components.

Thus, the embodiment of FIG. 7 is generally indicated by the numeral 110 and includes a base 120 which has sidewalls 121,121 and end walls 122,122. A support block 124 and a latch 125 are also optionally provided in this form of the invention. The frame support 140 is again pivotally secured to the base 120 between the support blocks 141,141 by the pivot arms 142,142 so that it is capable of pivoting about a horizontal axis.

The U-shaped frame 150 again includes a base 151 and projecting opposed legs 152,152 with a pivot rod 153 carried at the outboard ends.

The plate 170 is again pivotally carried by the rod 153 and includes a mirror 180 on one surface and outline shape 190 on the other. A handle 171 is also secured to the plate 170 and the detent means 160 are also provided so as to provide three preselected positions for pivoting of the frame 150 about the vertical axis for display purposes.

Use of operation of this form of the invention is identical with that of the embodiment of FIGS. 1 through 6 and it should also be understood that although not expressly illustrated, the outline shape 190 is again spaced from the face of the plate 170 and attachment means in the ear area are also provided.

Figure 8:
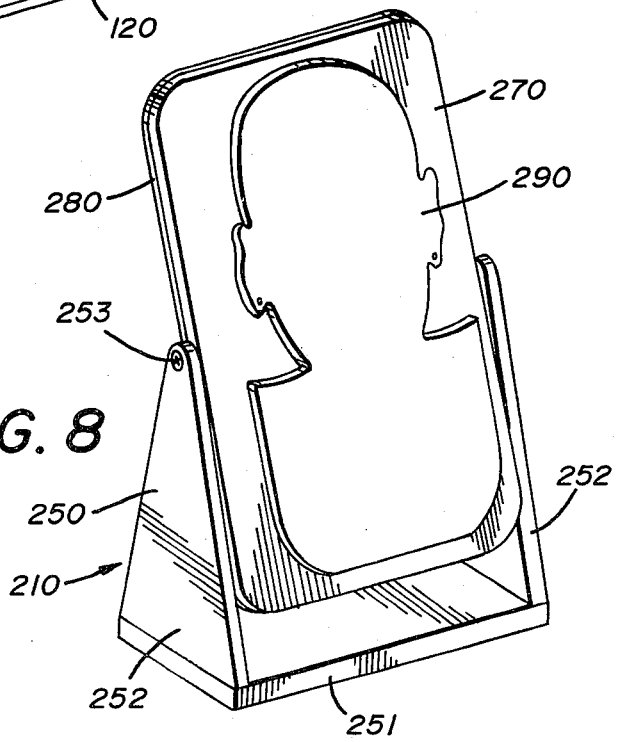
FIG. 8 is a perspective view of a second modified form of the invention.

FIG. 8 illustrates yet another embodiment of the invention and is essentially a free standing embodiment.

Again similar numerals prefixed in the 200 series will be employed to denote similar components.

Thus, the overall assembly 210 includes a frame 250 which has a base 251 and opposed legs 252,252. A pivot rod 253 passes between the legs 252,252 and the plate 270 is secured thereon.

Figure 4:
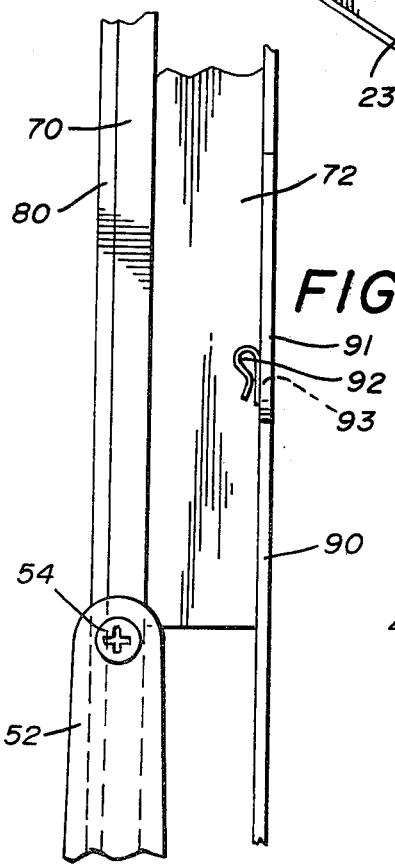
FIG. 4 is a sectional view taken along the line 4—4 of FIG. 2.
Figure 5:
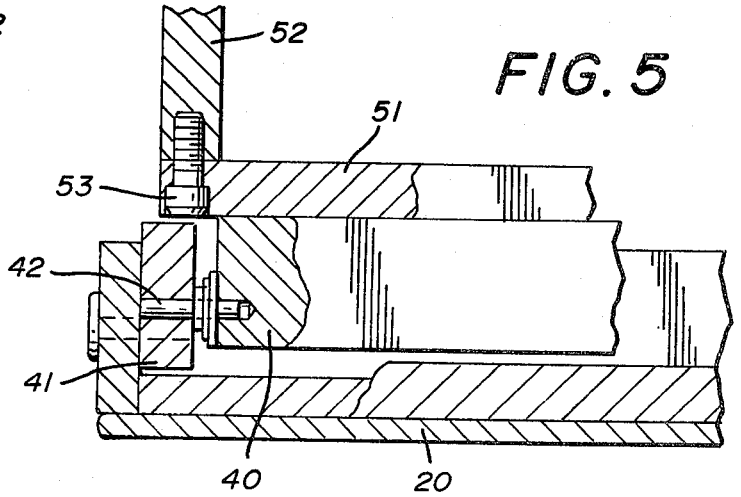
FIG. 5 is a sectional view taken along the line 5—5 of FIG. 2.

Opposed sides of the plate 270 carry a mirror 280 and the outline shape 290. Again, it should be understood that while not illustrated, a block similar to the block 72 illustrated in FIG. 4 is employed to support the outline shape 290 in a condition such that it is spaced from the surface of the plate 270 for access. Similarly, attachment means similar to the attachment means 92 of FIG. 4 are employed behind the ears so that the earrings can be affixed to the outline shape 290.

While a full and complete description of the invention has been set forth in accordance with the dictates of the Patent Statutes, it should be understood that modifications can be resorted to without departing from the spirit of the invention or the scope of the appended claims.

What is claimed is:

1. A display assembly for jewelry or the like, comprising:

(A) a frame support;

(B) a frame projecting from one surface of said frame support;

(C) a plate pivotally carried by said frame for movement about an axis parallel to the longitudinal axis of said frame support;

(D) an outline shape simulating at least the head of a human being disposed on one side of said plate;

(E) a reflective member disposed on the opposed side of said plate;

(F) said outline shape being fixed to and spaced from the surface of said plate; and (G) attachment means carried on the ear lobes of said outline shape.

2. A display assembly for jewelry or the like, comprising:

(A) an elongate base;

(B) a frame support pivotally secured to one end of said base;

(C) a frame pivotally secured to said frame support for movement about an axis normal to the axis of movement of said frame support;

(D) a plate pivotally carried by said frame for movement about an axis parallel to the axis of movement of said frame;

(E) an outline shape simulating at least the head of a human being disposed on one side of said plate; and (F) a reflective member disposed on the opposed side of said plate.

3. The display assembly of claim 2 wherein said outline shape is spaced from the surface of said plate.

4. The display assembly of claim 3 wherein attachment means are carried on the ear-lobes of said outline shape.

5. The display assembly of claim 2 wherein latch means are carried by said base for releasably securing said frame to said base.

6. The display assembly of claim 2 wherein detent means are carried by said frame support and said frame for selectively controlling the position of said frame relatively of said frame support.

7. The display assembly of claim 2 wherein a handle is disposed on one surface of said plate.

8. A jewelry display assembly for jewelry or the like, comprising:

(A) a base;

(B) a cover hinged to said base;

(C) a display unit (a) attached to said base and (b) being movable into and out of said base about an axis normal to the hinge axis between said cover and said base; and (D) said display unit including an outline shape simulating at least the head of a human being for displaying the jewelry.

9. The display assembly of claim 8 wherein said base and said cover are movable between open and closed positions; and locking means carried by said base and said cover for releasably and selectively securing said base and said cover in the closed position.

10. The display assembly of claim 8 wherein latch means are carried by said base for releasably securing said display unit within said base.

11. The display assembly of claim 8 or 10 wherein (A) said display unit includes (1) a frame support pivotally secured to said base and (2) a frame carried by and projecting from said frame support; and (B) said frame being pivotally attached to said frame support for movement about an axis normal to the pivoting axis of said frame support.

12. The display assembly of claim 11 wherein (A) said display unit further includes a support arm pivotally carried by said frame for movement about an axis normal to the pivoting axis of said frame; and (B) said outline shape being carried by said support arm.

13. The display assembly of claim 11 wherein detent means are carried by said frame support and said frame for selectively controlling the position of said frame relatively of said frame support.

14. The display assembly of claim 11 wherein said display unit includes (A) a plate having a reflective surface on one side thereof; and (B) said outline shape being carried by the opposed side of said plate.

15. The display assembly of claim 14 wherein said outline shape is spaced from the surface of said plate upon which it is carried.

16. The display assembly of claim 11 wherein attachment means are carried on the ear-lobes of said outline shape.

17. The display assembly of claim 14 wherein a handle is disposed on one surface of said plate.

* * * * *